United States Patent [19]

Cowan

[11] 4,208,227

[45] Jun. 17, 1980

[54] INTERNALLY STRESSED CLUB HOLDING COLLARS FOR GOLF BAGS

[76] Inventor: Wallace C. Cowan, 316 S. Detroit, Russellville, Ark. 72801

[21] Appl. No.: 961,098

[22] Filed: Nov. 16, 1978

[51] Int. Cl.[2] ..... A63B 55/00

[52] U.S. Cl. ..... 150/1.5 R

[58] Field of Search ..... 150/1.5 R, 1.5 C, 52 C, 150/52 R

[56] References Cited

U.S. PATENT DOCUMENTS

| | | | |
|---|---|---|---|
| 1,756,902 | 4/1930 | Boyce | 150/1.5 R |
| 1,840,183 | 1/1932 | Blitch | 150/1.5 R |
| 1,849,610 | 3/1932 | Boyce | 150/1.5 R |
| 1,955,650 | 4/1934 | Obarski | 150/1.5 C |
| 3,503,518 | 3/1970 | Black | 150/1.5 R |
| 3,674,072 | 7/1972 | Shuto | 150/1.5 R |
| 3,747,654 | 7/1973 | Wilson | 150/1.5 R |
| 4,055,207 | 10/1977 | Goodwin | 150/1.5 R |

*Primary Examiner*—Herbert F. Ross

[57] ABSTRACT

A wrap-around club holding collar for golf bags having an annular cross-section and comprising an annular resilient band extending axially from the bag mouth and having spaced edge notches in its extended marginal edge portion, said notches being maintained in optimum shape for releasably gripping the club heads by internal stresses generated when wrapping the band around the bag mouth periphery.

The collar band is preferably formed from a blank of equilibrized or equipoised resilient material and then wrapped and secured around the mouth periphery, at which time, internal compressive and tensile bending stresses are generated in the inner and outer wall segments of the band respectively. The compressive stress decreases the length of the inner wall arcuate segments along with the widths of the transverse notch lengths in the extending marginal edge portion thereof, while the tensile stress increases the length of the outer wall arcuate segment and the widths of the notch lengths therein forming continuations of the respective first named notch lengths, thereby causing the notch lengths in the concave inner wall arcuate segments to exert the major gripping action upon the respective club heads when inserted in the notches.

2 Claims, 8 Drawing Figures

14d
7
y

INTERNALLY STRESSED CLUB HOLDING COLLARS FOR GOLF BAGS

This invention relates to club supporting collars for golf bags and more especially to a resilient laterally yieldable annular band forming an axial extension of and detachably secured to the periphery of the bag mouth.

Heretofore, numerous attachments have been provided which suspend golf clubs from the heads thereof in predetermined systematic orders and positions when carried or stored in golf bags, as shown in U.S. Pat. Nos. 1,840,183, 1,849,610 and 3,503,518. Such attachments are relatively rigid and incapable of efficiently resisting and absorbing ordinary impacts to which the playing equipment is subjected during transportation and use, thus resulting in damage and club disarrangement. The basic cause of this problem is the lack of lateral flexibility and resiliency of the attachment at the points where the clubs are suspended. So far as applicant is aware, no prior art club holders have been devised which overcome the above-mentioned drawback by providing a resilient wrap-around collar or band having edge notches therein for releasably gripping the heads of club irons and suspending their shafts inside the bag, wherein the gripping force of each notch is a function of the internal bending stress generated in the bend in its wrapped position.

It is therefore an object of this invention to provide an internally stressed annular resilient club suspending collar having one marginal end portion thereof wrapped around and overlapping the mouth periphery of the golf bag and its opposite marginal end portion forming an axial extension projecting beyond the bag mouth, the latter marginal portion being laterally yieldable and provided with edge notches reponsive to the bending stresses in the wrapped collar for releasably gripping the heads of golf irons.

It is another object of invention to provide an internally stressed annular wrap-around golf club holder of the class described which may be formed to its approximate shape from a blank of equilibrized or equipoised resilient material and then wrapped around the mouth periphery of the bag to generate bending stresses which, in turn, cause the extended marginal edge portion of the holder to flare outwardly while causing the edge notches therein to assume final shapes suitable for gripping the heads of the playing irons.

It is yet another object of invention to provide a club holder of the class described which is simple in construction, relatively easy to manufacture, safe and convenient to use, and which adds negligible weight when installed upon a golf bag.

Some of the objects of invention having been stated, other objects will appear as the description proceeds when taken in connection with the accompanying drawings, in which, FIG. 1 is a top plan view of my improved club holder mounted upon a golf bag;

Figure 1:
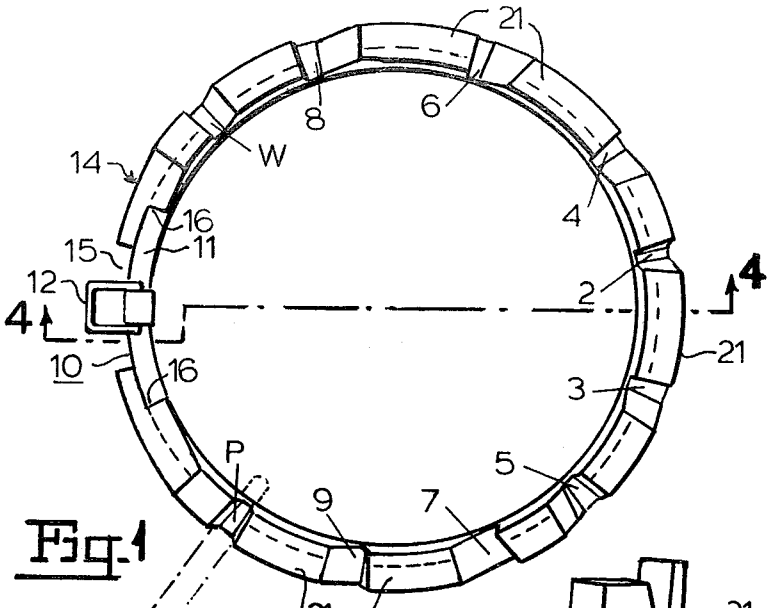
Figure 2:
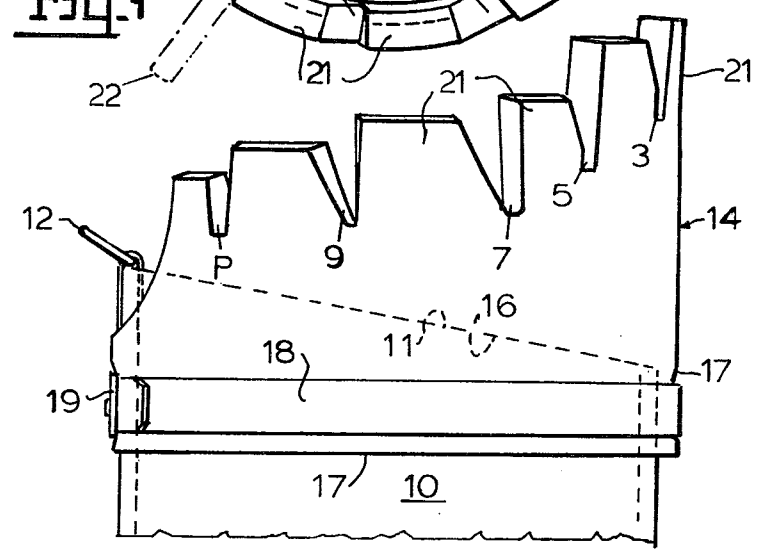
FIG. 2 is an elevational view looking at the near side of FIG. 1.

Referring more specifically to the drawings, the numeral 10 designates a conventional cylindrical golf bag having a sloped mouth 11 and a support ring 12 to which a sling (not shown) may be attached. My improved club holder or collar 14 is adapted to be wrapped around the periphery of mouth portion 11 of the cylindrical bag 10 as well as upon numerous variations in size and in arcuate cross-sectional shape thereof as will become apparent from the following description.

The holder 14, when installed as shown in FIGS. 1-4, comprises a split collar having a space 15 between its ends, said holder also being provided with an L-shaped notch 16 formed on its inside wall face and along its lower marginal edge portion 17. This notch permits the collar to be seated upon the upper perimeter of sloped mouth 11 while the adjacent marginal portion overlaps the mouth periphery therebelow. With the collar so positioned, a suitable fastening means such as belt 18 and associated buckle 19 are employed to adjustably bind the overlapping portion around the bag mouth portion 11 and upon mouths of other bags of various sizes and annular shaped cross-section.

Holder 14 is provided with an outwardly flared or funnelshaped upper marginal portion 21 in which suitable club head receiving notches W, P, and 2-9 are formed with an intervening jaw segment between each pair of adjacent notches, said notches being shaped to fit the heads of playing irons usually designated by corresponding letters and numerals. For example, the head of putter iron 22 is shown inserted in notch P in FIG. 1. Thus the notched marginal edge portion 21 defines the perimeter of the holder mouth or the access opening 11 to the bag.

Figures 5, 6, 7, 8:
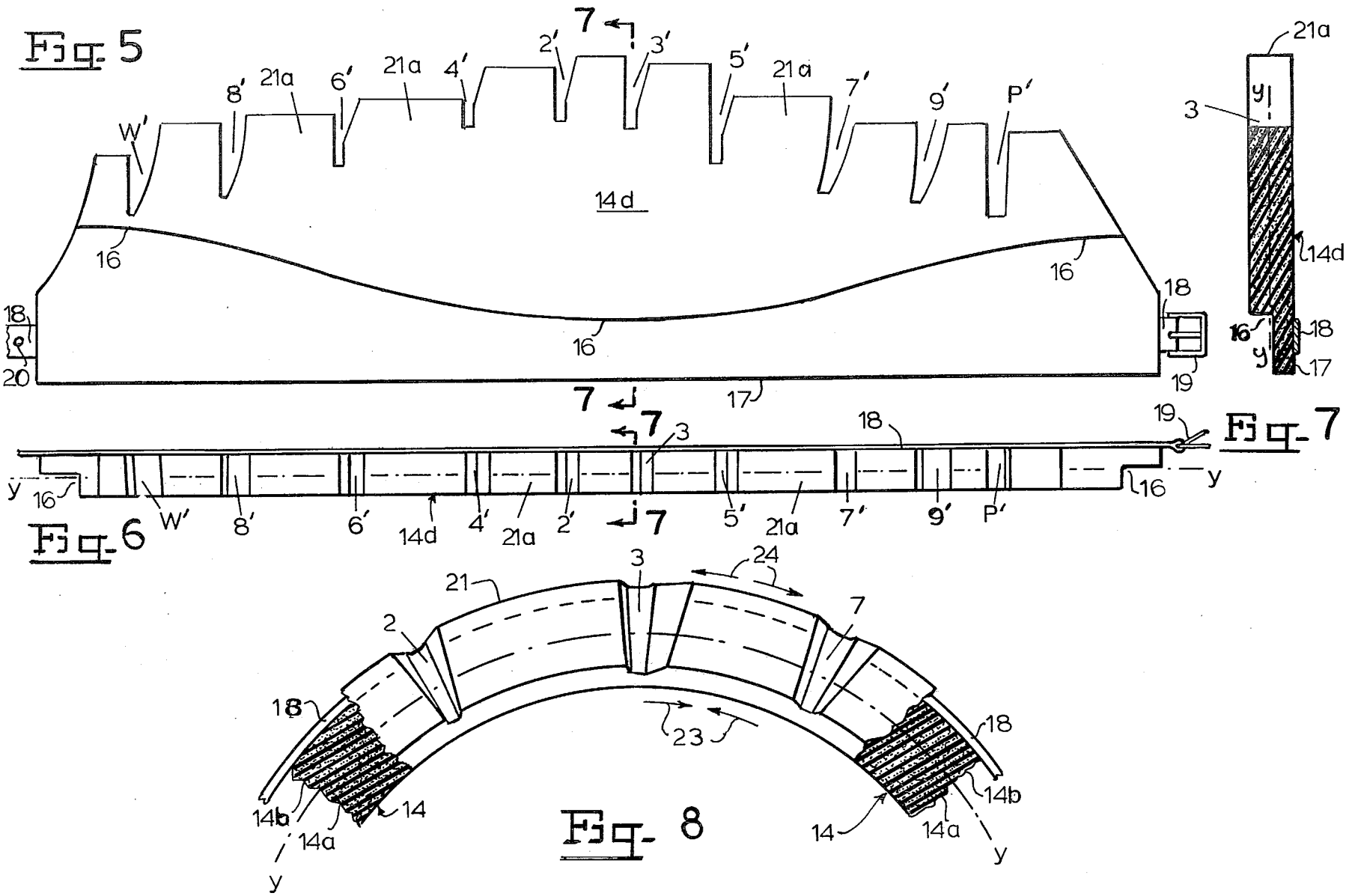
FIG. 5 is a developed view of the inside face of a blank from which the holder shown in FIGS. 1-4 is made.
FIG. 6 is a top edge plan view of FIG. 5.
FIG. 7 is a vertical sectional view taken along lines 7—7 in FIGS. 5 and 6.
FIG. 8 is an enlarged sectional view showing an arcuate segment formed from the blank in FIGS. 5 and 6 after having been wrapped around the golf bag mouth.

The holder 14 is initially formed as an equilibrized resilient blank **14*d* while in its flat developed shape as shown in FIGS. 5-7, and with edges notches W' P' and 2'-9' cut to their approximate shapes in upper marginal edge portion 21*a*. Then the blank is wrapped and fastened around the mouth portion 11 to generate internal stresses which transform the partially shaped notches to their final shapes as indicated by reference characters W, P and 2-9 in FIGS. 1-4 as well as 8 and to outwardly flare the intervening jaw segment between each pair of adjacent notches of access opening as at 21. More specifically, compressive and tensile stresses are generated on the opposite sides of neutral internal stress axis y—y and in inner and outer annular wall segments or wall thicknesses 14*a* and 14*b* respectively, as indicated by compression arrows 23, 23 and tension arrows 24, 24. The compressive stress causes inner wall segment 14*a* to shorten and the outer wall segment 14*b* to stretch which, in turn, decreases the circumferential widths of the inner lengths of the edge notches in segment 14*a* and increases the widths of the outer lengths of the corresponding notches in segment 14*b***.

Figure 3:
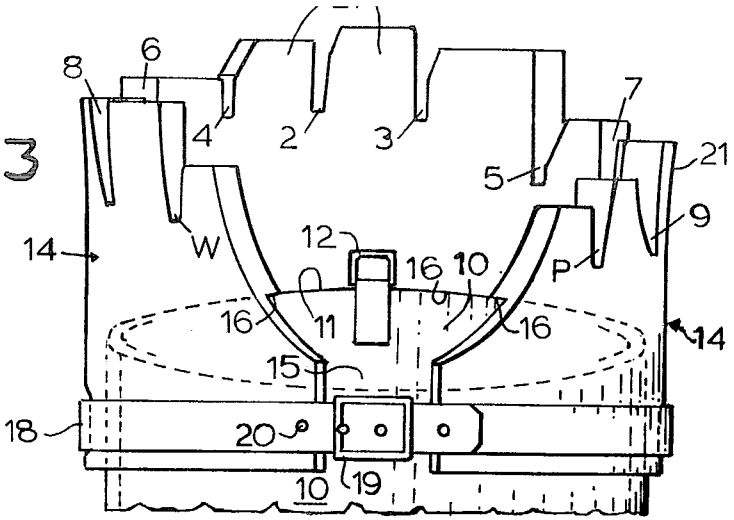
FIG. 3 is an elevational view looking at the lefthand side of FIG. 1.
Figure 4:
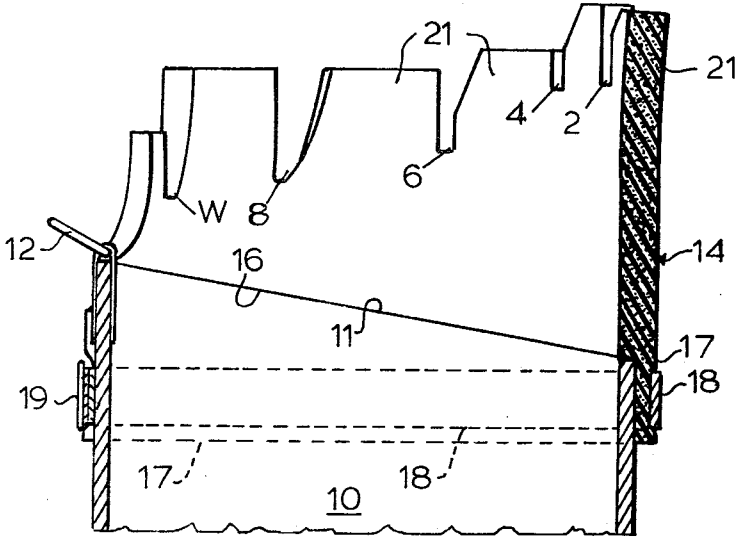
FIG. 4 is a vertical sectional view taken along line 4—4 in FIG. 1.

It is therefore apparent that the gripping or clamping force exerted by the opposed walls of each notch length in the inner collar or band segment **14*a* upon the inserted iron head is a function of the internal compressive stress generated in this segment as the band is bent or wrapped around the peripheral mouth portion of the bag; and further, that the quantity of this compressive stress and its resultant gripping force is, in turn, a function of the degree of curvature of the band and the mouth portion around which it is wrapped. Moreover, the internal stresses in the collar, both compressive and tensional, are maintained only so long as the belt is in fastened position as shown in FIG. 3, the tensional stress in the band serving to relieve the iron heads from notch pressures while the compressive stress increases the notch pressure generated by the bending stress. Of course, when buckle 19 is unfastened, the internal stresses will be released to allow the band or collar to expand toward its equilibrized position as shown in FIGS. 5 and 6. Thus, the term internally stressed as used in this application means that compressive and tensional stresses 23 and 24 are built up in the inner and outer arcuate segments 14***a* and 14*b* respectively of holder 14.

When a split annular collar is molded in an equilibrized, there are no internally acting stresses which generate and maintain the notch width and flare in the holder 14 of the first embodiment of FIGS. 1–8, but instead, the inherent strength of the collar performs these functions. Thus, the annular equilibrized holder normally and yieldingly resists expansion or change of shape from that when molded. Conversely, the equilibrized blank 14*d* (FIGS. 5–7) normally and yieldingly change of shape when bending stresses are generated during wrapping to installed position. Accordingly, the equilibrized molded holders when detached are more suitable to be nested one within the other for packaging purposes, while the flate equilibrized holder blanks 14*d* are more suitably shaped to be superimposed face-to-face when packaged.

I claim:

1. In combination with an elongated golf bag (10) having a mouth (11) at the upper end thereof, an internally stressed club holding collar (14) forming a vertical axial extension of the mouth and adapted to releasably suspend club irons from their respective heads (22) and within the bag, said collar being produced from (a) a substantially rectangular equilibrized blank (14*d*) of resilient compressible and stretchable material, said blank having a neutral stress axis (y—y) between its opposite longitudinal wall segments;

(b) one longitudinal marginal edge portion (21) of said blank being provided with a plurality of spaced transverse notches (W′, P′ and 2′ thru 9′) with an intervening jaw segment between each pair of adjacent notches, the opposed faces of said notches being substantially congruent to the opposite faces of said iron heads respectively;

(c) the marginal edge portion (17) disposed opposite the aforementioned edge portion (21) being bent around the outer periphery of the mouth portion to

(1) tensionally stress and increase the length of the arcuate segment (14*b*) disposed outwardly of said neutral axis and concurrently

(2) compressively stress and reduce the length of the arcuate segment (14*a*) disposed inwardly of said neutral axis, whereby the distance between the opposed faces of each notch length in said tensionally stressed segment (14*b*) is increased, and the distance between the opposed faces of the corresponding notch lengths in the compressively stressed segment (14*a*) is decreased, and whereby the opposed faces of the corresponding notch length in the compressively stressed segment will have lesser widths than the iron head portions inserted therein to thereby grip the respective portions, and (d) means (18, 19) for maintaining said arcuate segments (14*a*, 14*b*) around the periphery of said bag mouth portion and in said bent internally stressed condition.

2. The combination defined in claim 1 wherein said intervening jaw sgments are held in outwardly flared positions relative to the vertical axis of the bag in response to said tensional and compressive stresses in said outer and inner arcuate wall segments, respectively.

* * * * *